US009488384B2

(12) United States Patent
Leman

(10) Patent No.: US 9,488,384 B2
(45) Date of Patent: Nov. 8, 2016

(54) HEAT PUMP WATER MODULE WITH CONDENSING COIL IN WATER STORAGE TANK

(71) Applicant: Carrier Corporation, Farmington, CT (US)

(72) Inventor: Derek Leman, Brownsburg, IN (US)

(73) Assignee: Carrier Corporation, Jupiter, FL (US)

( * ) Notice: Subject to any disclaimer, the term of this patent is extended or adjusted under 35 U.S.C. 154(b) by 137 days.

(21) Appl. No.: 14/178,031

(22) Filed: Feb. 11, 2014

(65) Prior Publication Data

US 2014/0283540 A1 Sep. 25, 2014

Related U.S. Application Data

(60) Provisional application No. 61/804,309, filed on Mar. 22, 2013.

(51) Int. Cl.

| | |
|---|---|
| ***F24F 5/00*** | (2006.01) |
| ***F24D 17/00*** | (2006.01) |
| ***F24H 4/04*** | (2006.01) |
| ***F24D 19/10*** | (2006.01) |

(52) U.S. Cl.

CPC ..... *F24H 4/04* (2013.01); *F24D 19/1054* (2013.01); *F24F 5/0096* (2013.01); *F24D 2200/24* (2013.01)

(58) Field of Classification Search

CPC .. F24D 17/00; F24D 17/0005; F24D 17/001; F24D 17/0052; F24D 17/0057; F24D 17/02; F24D 3/08; F24D 3/082; F24D 3/085; F24D 11/0214; F24D 19/1051; F24D 19/1054; F24D 19/1056; F25B 2339/047; F25B 2313/003; F25B 2313/004; F25B 9/00; F25B 9/003; F25B 13/00; F25B 30/00; F25B 30/02; F25B 30/06; F25B 2313/023; F25B 2313/0231; F25B 2313/0233; F25B 2313/02331; F25B 2313/02334

See application file for complete search history.

(56) References Cited

U.S. PATENT DOCUMENTS

| | | | | |
|---|---|---|---|---|
| 2,516,094 | A | | 7/1950 | Ruff |
| 2,575,325 | A | | 11/1951 | Russell et al. |
| 2,690,649 | A | | 10/1954 | Borgerd |
| 2,696,085 | A | | 12/1954 | Ruff |
| 2,968,934 | A | | 1/1961 | Mieczyslaw |
| 4,041,726 | A | | 8/1977 | Mueller et al. |
| 4,173,872 | A | | 11/1979 | Amthor, Jr. |
| 4,290,275 | A | | 9/1981 | Disco et al. |
| 4,592,206 | A | * | 6/1986 | Yamazaki et al. ..... 62/160 |
| 4,747,273 | A | | 5/1988 | Cook et al. |
| 4,893,476 | A | * | 1/1990 | Bos ..... F24D 11/0214 62/238.6 |
| 5,355,688 | A | * | 10/1994 | Rafalovich et al. ..... 62/117 |
| 5,680,898 | A | * | 10/1997 | Rafalovich ..... F24F 5/0017 165/236 |
| 5,906,109 | A | | 5/1999 | Dieckmann et al. |

(Continued)

FOREIGN PATENT DOCUMENTS

| | | |
|---|---|---|
| CN | 100398936 | 7/2008 |
| FR | 2628189 | 9/1989 |
| GB | 2240163 | 7/1991 |

*Primary Examiner* — Frantz Jules
*Assistant Examiner* — Erik Mendoza-Wilkenfe
(74) *Attorney, Agent, or Firm* — Ice Miller LLP

(57) ABSTRACT

A water heater module with a heat exchanger configured to be submersible inside a water storage tank, and further configured to divert refrigerant between the heat exchanger and an air handler in response to a demand for heating water or a demand for conditioning an interior space.

15 Claims, 2 Drawing Sheets

(56) References Cited

U.S. PATENT DOCUMENTS

| | | | | |
|---|---|---|---|---|
| 5,983,660 | A * | 11/1999 | Kiessel et al. | 62/324.5 |
| 6,327,871 | B1 | 12/2001 | Rafalovich | |
| 2006/0032244 | A1 | 2/2006 | Tomlinson | |
| 2009/0133413 | A1* | 5/2009 | Matsuoka et al. | 62/77 |
| 2010/0078160 | A1* | 4/2010 | Novotny et al. | 165/247 |
| 2011/0016897 | A1* | 1/2011 | Akagi et al. | 62/161 |
| 2011/0023512 | A1* | 2/2011 | Kawagoe et al. | 62/196.1 |
| 2011/0232308 | A1* | 9/2011 | Morimoto et al. | 62/132 |
| 2012/0060535 | A1* | 3/2012 | Crosby et al. | 62/238.7 |
| 2013/0104574 | A1* | 5/2013 | Dempsey et al. | 62/79 |

* cited by examiner

HEAT PUMP WATER MODULE WITH CONDENSING COIL IN WATER STORAGE TANK

CROSS REFERENCE TO RELATED APPLICATIONS

The present application is related to, and claims the priority benefit of, U.S. Provisional Patent Application Ser. No. 61/804,309 filed Mar. 22, 2013, the contents of which are hereby incorporated in their entirety into the present disclosure.

TECHNICAL FIELD OF THE DISCLOSED EMBODIMENTS

The presently disclosed embodiments generally relate to heat pump water heaters, and more particularly, to a heat pump water module with a condensing coil in a water storage tank.

BACKGROUND OF THE DISCLOSED EMBODIMENTS

A typical water heater for residential hot water production and storage is an electrical resistance water heater and storage tank, although gas water heaters are also used to heat water in a storage tank. Water heaters typically include a storage tank defining a chamber for retention of water. A water inlet pipe is provided with a first connection for interconnection with a cold water supply line that conveys fresh, relatively cold water into the storage tank. In the case of electrical resistance water heaters, there are electrical resistance elements, within the storage tank, that heat the water.

An alternative method for heating water is an active desuperheater water heater. In one example of an active desuperheater water heater, the active desuperheater water heater uses a small pump to circulate water from a water storage tank, through a heat exchanger, and back into the water storage tank. The active desuperheater water heater intercepts the superheated hot gas that is rejected from an air conditioner or heat pump compressor, sitting outside the home, and transfers the heat to the water circulating through the heat exchanger. The active desuperheater water heater works only when the air conditioner or heat pump is operating in a cooling mode.

Another alternative method for heating water is a heat pump water heater. A heat pump water heater contains a fan, compressor, and evaporator configured to sit on top of the water heater storage tank. The heat pump water heater circulates a refrigerant through an evaporator and compressor, and uses a fan and evaporator to pull heat from air surrounding the heat pump water heater in order to heat the refrigerant. The heated refrigerant runs through a condenser coil within the water storage tank, transferring heat to the water stored therein.

SUMMARY OF THE DISCLOSED EMBODIMENTS

In one aspect, a heat pump water heater module is provided. The heat pump water module includes a heat exchanger, to be submerged inside a water storage tank, which allows a refrigerant to circulate therethrough. The heat pump water module also has a plurality of valves, wherein at least one of the plurality of valves is coupled to the heat exchanger via a conduit. The heat pump water module further includes a controller in electrical communication with the plurality of valves. Furthermore, the controller executes instructions to operate at least one of the plurality of valves in response to a demand to heat water or in response to conditioning an interior space.

In one embodiment, a system for heating water and conditioning an interior space is disclosed. Particularly, the system includes a water heater module having a plurality of valves to direct a refrigerant through a first heat exchanger submerged in a water storage tank. The system further includes an outdoor unit assembly operably coupled to the water heater module, and an indoor unit assembly operably coupled to the water heater module.

During a demand to heat water, the water heater module operates at least one of a plurality of valves to direct a refrigerant to the heat exchanger submerged in a water storage tank. The outdoor unit assembly operates to circulate the refrigerant through the water heater module to transfer heat to water stored in a water storage tank.

During a cooling or heating demand to condition an interior space, the water heater module operates at least one of a plurality of valves to direct a refrigerant to an indoor unit assembly. The outdoor unit assembly operates in a heating or cooling mode by circulating a refrigerant through the water heater module to the indoor unit assembly, wherein the indoor unit assembly operates to distribute air within the interior space.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
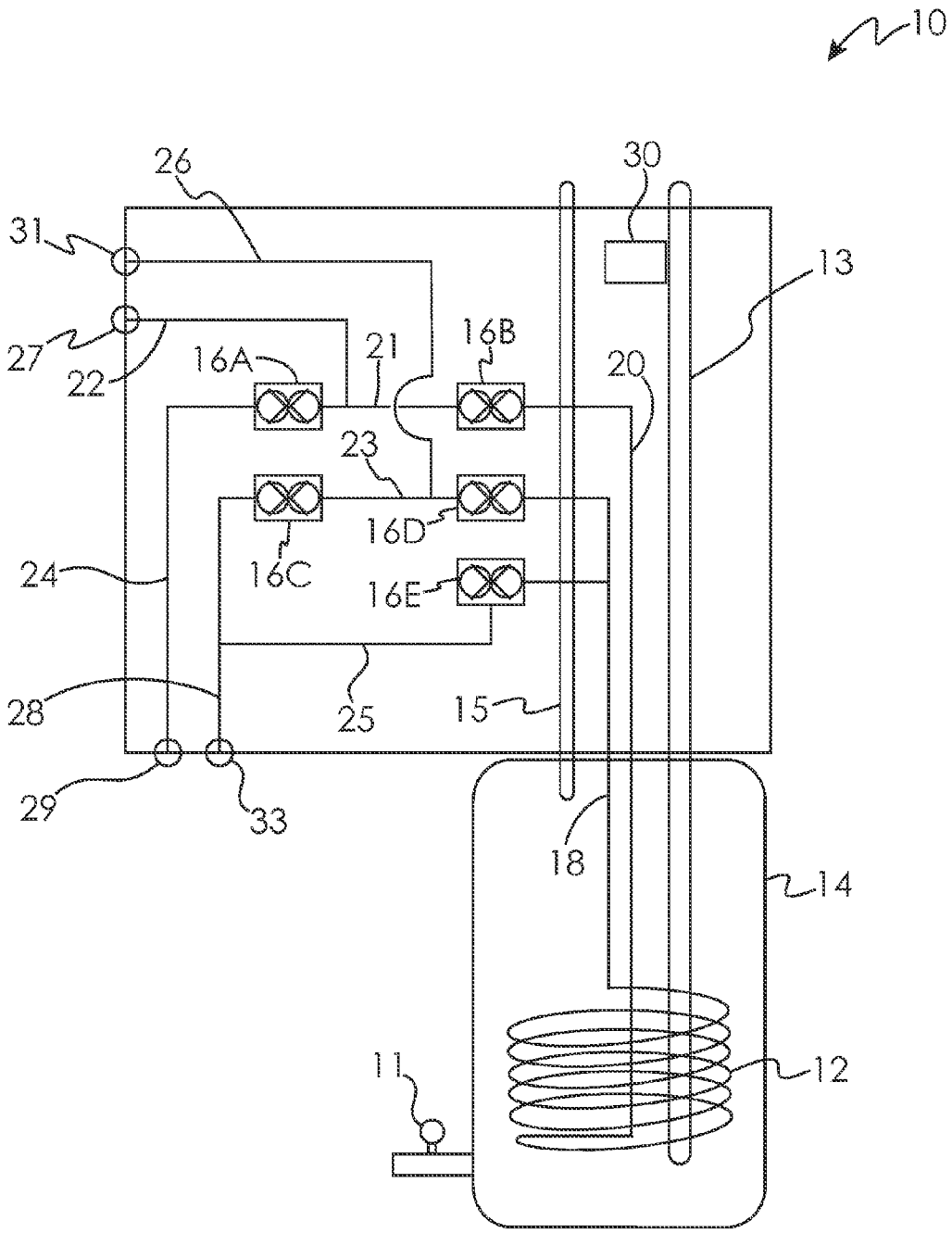
FIG. 1 is a schematic diagram of a water heater module with a heat exchanger submerged within a water storage tank in an exemplary embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an embodiment of a water heater module, indicated generally at 10. Particularly, the water heater module 10 includes a heat exchanger 12 that is submerged inside a water storage tank 14, wherein the heat exchanger 12 allows a refrigerant to circulate therethrough. Water storage tank 14 includes a drain valve 11, a hot water supply line 13, and a cold water supply line 15. The water heater module 10 includes a plurality of valves 16A-D to direct the flow of the refrigerant therethrough. The supply side inlet of heat exchanger 12 is coupled to valve 16D via a conduit 18. The return side outlet of heat exchanger 12 is coupled to valve 16B via a conduit 20. A valve 16A is coupled to valve 16B via a conduit 21. A valve 16C is coupled to valve 16D via a conduit 23. A pressure-operated valve 16E is coupled to a conduit 18 for relieving gas pressure within water heater module 10. Pressure-operated valve 16E is further coupled to the indoor unit assembly supply conduit 28 via a conduit 25. The valves 16A and 16B are further coupled to an outdoor unit assembly return connector 27 via a conduit 22. Valve 16A is further coupled to an indoor unit assembly return connector 29 via a conduit 24. It will be appreciated that the valves 16A and 16B, together with the conduits 21, 22 and 24, function as a first three-way valve. The valves 16C and 16D are further coupled to an outdoor unit assembly supply connector 31 via a conduit 26. Valve 16C is further coupled to an indoor unit assembly supply connector 33 via a conduit 28. It will be appreciated that the valves 16C and 16D, together with the conduits 23, 26, and 28 function as a second three-way valve.

A controller 30 is operably coupled to each of the plurality of valves 16A-D for control thereof, for example by electrical communication with the valves 16A-D. In some embodiments, the controller 30 includes a microprocessor, preprogrammed with software stored in nonvolatile memory for executing instructions. The controller 30 provides the water heater module 10 with a variety of operation modes and control sequences to execute instructions during one of an interior space conditioning mode or water heating mode.

Figure 2:
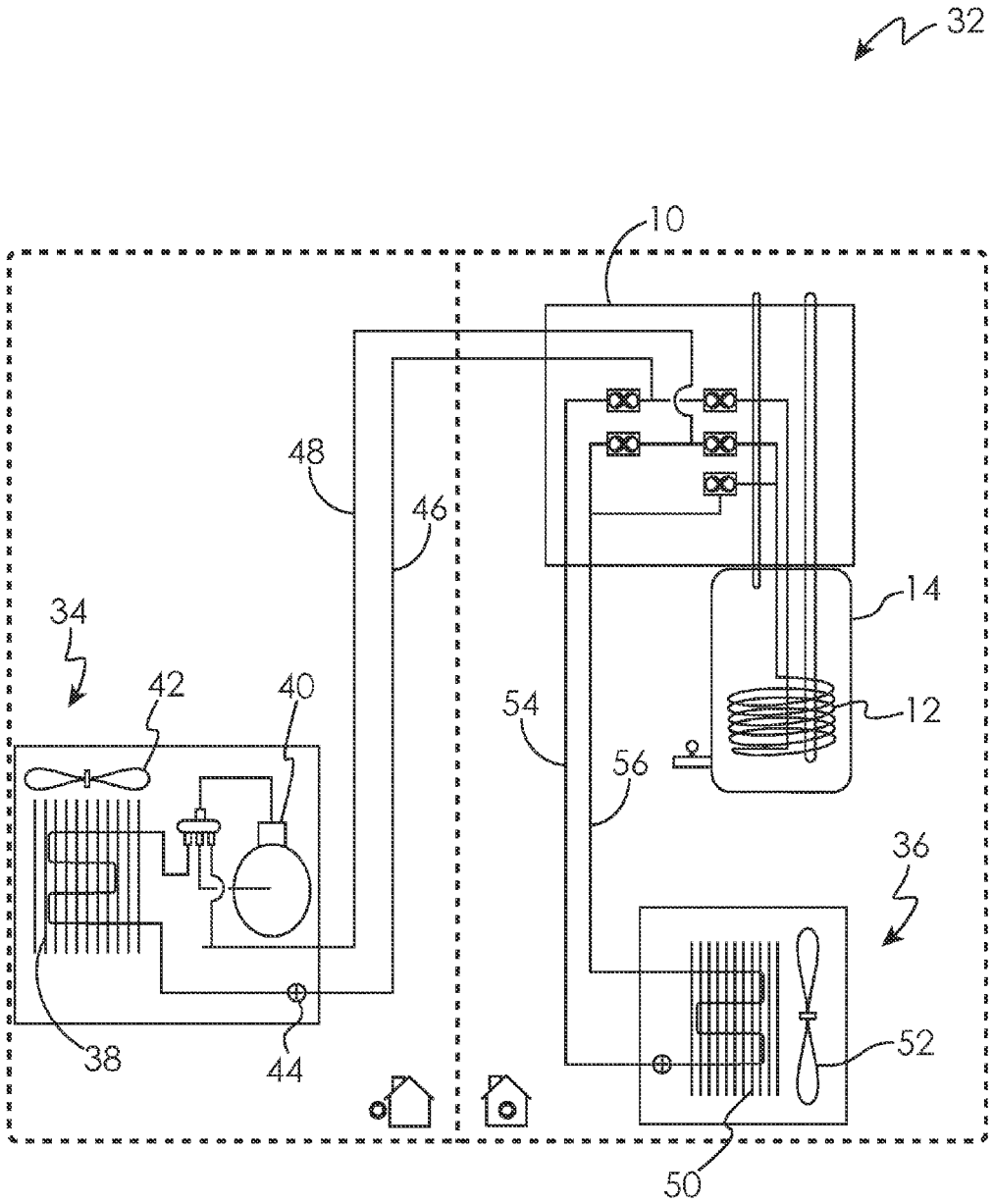
FIG. 2 is a schematic diagram of a system for heating water and conditioning an interior space in an exemplary embodiment.

FIG. 2 illustrates a system for heating water and conditioning an interior space, according to one embodiment, and indicated generally at 32. Particularly, the system 32 includes a water heater module 10 having a plurality of valves 16A-D to direct a refrigerant through a first heat exchanger 12 submerged in a water storage tank 14. System 32 further includes an outdoor unit assembly 34 operably coupled to the water heater module 10. System 32 further includes an indoor unit assembly 36 operably coupled to the water heater module 10.

Outdoor unit assembly 34 includes a second heat exchanger 38, a compressor 40, a fan 42, and an expansion device 44. In one embodiment, outdoor unit assembly 34 may be an air-to-air heat pump, to name one non-limiting example. In another embodiment, outdoor unit assembly 34 may be a ground source heat pump, to name another non-limiting example. Outdoor unit assembly 34 is coupled to the outdoor unit assembly return connector 27 via a conduit 46. Outdoor unit assembly 34 is coupled to the outdoor unit assembly supply connector 31 via a conduit 48.

Indoor unit assembly 36 includes a third heat exchanger 50, and an indoor fan 52. In one embodiment, indoor unit assembly 36 may be an air handler, to name one non-limiting example. Indoor unit assembly 36 is coupled to the indoor unit assembly return connector 29 via a conduit 54. Indoor unit assembly 36 is coupled to the indoor unit assembly supply connector 33 via a conduit 56.

Water heater module 10 is in communication with outdoor unit assembly 34 and indoor unit assembly 36 via a wired or wireless connection (not shown). Water heater module 10 operates to switch outdoor unit assembly 34 and indoor unit assembly 36 between an interior space conditioning mode and a water heating mode.

As is known in the art, a water storage tank such as the tank 14 is designed to produce a signal to indicate when a water heating mode should be initiated. During a demand to heat water, water storage tank 14 sends a signal to water heater module 10 to operate in a water heating mode. Water heater module 10 sends a signal to outdoor unit assembly 34 to operate in a heating mode. In response to the request to operate in a water heating mode, water heater module 10 controls the flow of a refrigerant through a first refrigerant circuit by controller 30 commanding valves 16B and 16D to be placed in an open state, and commanding valves 16A and 16C to be placed in a closed state. Outdoor unit assembly 34 operates in a heating mode by circulating a refrigerant through second heat exchanger 38, compressor 40, and into conduit 48. The refrigerant enters through outdoor unit assembly supply connector 31, wherein the refrigerant is directed through valve 16D and circulates through heat exchanger supply conduit 18. The refrigerant circulates through heat exchanger 12 and exits heat exchanger 12 via heat exchanger return conduit 20. The refrigerant is directed through valve 16B, and exits through outdoor unit assembly return connector 27. The refrigerant returns to outdoor unit assembly 34 via conduit 46. As the refrigerant circulates through the aforementioned circuit, heat is transferred from heat exchanger 12 to the water stored within water storage tank 14. The refrigerant will continue to circulate through the first refrigerant circuit until the water heating demand is satisfied.

During a heating or cooling demand to condition an interior space, indoor unit assembly 36 receives a signal from a sensor (not shown) positioned within the interior space. Indoor unit assembly 36 sends a signal to outdoor unit assembly 34 to operate in a cooling or heating mode, depending upon the signal received from the sensor. In the interior space conditioning mode, water heater module 10 controls the flow of a refrigerant through a second refrigerant circuit by controller 30 sending a signal to valves 16A and 16C to be placed in an open state, and sending a signal to valves 16B and 16D to be placed in a closed state. Outdoor unit assembly 34 operates in a heating mode by circulating a refrigerant through second heat exchanger 38, compressor 40, and into conduit 48. To operate in a cooling mode, outdoor unit assembly 34 reverses the flow of the refrigerant through the second heat exchanger 38 and compressor 40. The refrigerant enters through outdoor unit assembly supply connector 31 wherein the refrigerant is directed through valve 16C and exits through indoor unit assembly supply connector 33. The refrigerant enters indoor unit assembly 36 and circulates through third heat exchanger 50. The refrigerant exits indoor unit assembly 36 via conduit 54 and enters through indoor unit assembly return connector 33. The refrigerant is directed through valve 16A, and exits through outdoor unit assembly return connector 31. The refrigerant returns to outdoor unit assembly 34 via conduit 46. As the refrigerant circulates through the aforementioned circuit, indoor fan 52 operates to distribute air within the interior space. The refrigerant will continue to circulate through the second refrigerant circuit, and indoor fan 52 will continue to operate until the heating or cooling demand to condition an interior space is satisfied.

It will be appreciated that, because the refrigerant circulating between the outdoor unit assembly 34 and the indoor unit assembly 36 passes through the water heater module 10, the water heater module 10 may redirect the flow of refrigerant from the indoor unit assembly 36 to be used for heating water in the storage tank 14 when a water heating mode is commanded. Once the need for heating water within the storage tank 14 no longer exists, the water heater module 10 may once again allow the refrigerant to circulate between the outdoor unit assembly 34 and the indoor unit assembly 36 for conditioning of the interior space.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A water heater module comprising:

a first heat exchanger, configured for flow of a refrigerant therethrough and to be submersible inside a water storage tank, the first heat exchanger including an inlet and an outlet;

a first three-way valve directly coupled to the outlet via an outlet conduit;

a first connector directly coupled to the first three-way valve via a first conduit; and a second connector directly coupled to the first three-way valve via a second conduit;

wherein the first three-way valve is operable to direct the flow of the refrigerant from the first conduit to the second conduit in an interior space conditioning mode, and the first three-way valve is operable to direct the flow of the refrigerant from the outlet conduit to the second conduit in a water heating mode;

a second three-way valve operably directly coupled to the inlet via an inlet conduit; and a controller in communication with the first and second three-way valves;

wherein the controller is operable to operate the first and second three-way valves to configure a first refrigerant circuit to establish the water heating mode and to configure a second refrigerant circuit to establish the interior space conditioning mode.

2. The water heater module of claim 1, wherein the second three-way valve is further directly coupled to a third connector via a third conduit and a fourth connector via a fourth conduit.

3. The water heater module of claim 2, wherein the second three-way valve is operable to direct the flow of refrigerant from the third conduit to the fourth conduit in the interior space conditioning mode, and the second three-way valve is operable to direct the flow of the refrigerant from the fourth conduit to the inlet conduit in the water heating mode.

4. A system for heating water and conditioning an interior space comprising:

a water heater module comprising:

a first heat exchanger, configured for flow of a refrigerant therethrough and to be submersible inside a water storage tank, the first heat exchanger including an inlet and an outlet;

a first three-way valve directly coupled to the outlet via an outlet conduit;

a first connector directly coupled to the first three-way valve via a first conduit; and a second connector directly coupled to the first three-way valve via a second conduit;

wherein the first three-way valve is operable to direct the flow of the refrigerant from the first conduit to the second conduit in an interior space conditioning mode, and the first three-way valve is operable to direct the flow of the refrigerant from the outlet conduit to the second conduit in a water heating mode;

a second three-way valve directly coupled to the inlet via an inlet conduit; and a controller in communication with the first and second three-way valves;

wherein the controller is operable to operate the first and second three-way valves to configure a first refrigerant circuit to establish the water heating mode and to configure a second refrigerant circuit to establish the interior space conditioning mode;

an outdoor unit assembly operably coupled to the water heater module;

an indoor unit assembly operably coupled to the water heater module.

5. The system of claim 4, wherein the outdoor unit assembly comprises a second heat exchanger, a compressor, a fan, and an expansion device.

6. The system of claim 4 wherein the indoor unit assembly comprises a third heat exchanger and an indoor fan.

7. The system of claim 4, wherein the water heater module operates between the interior space conditioning mode and the water heating mode.

8. The system of claim 5, wherein the outdoor unit assembly is coupled to the water heater module via a plurality of first conduits, and the indoor unit assembly is coupled to the water heater module via a plurality of second conduits to allow a refrigerant to flow therethrough.

9. The system of claim 5, wherein the water heater module controls the flow of the refrigerant through the second refrigerant circuit in response to the interior space conditioning mode.

10. The system of claim 5, wherein the water heater module controls the flow of the refrigerant through the first refrigerant circuit in response to the water heating mode.

11. The system of claim 8, wherein the outdoor unit assembly operates in a heating or cooling mode, and is configured to circulate the refrigerant through the second refrigerant circuit in response to the interior space conditioning mode.

12. The system of claim 8, wherein the outdoor unit assembly operates in a heating mode, and is configured to circulate the refrigerant through the first refrigerant circuit in response to the water heating mode.

13. The system of claim 11, wherein the indoor unit assembly is configured to circulate air in response to the interior space conditioning mode.

14. The system of claim 4, wherein the second three-way valve is directly coupled to a third connector via a third conduit and directly coupled to a fourth connector via a fourth conduit.

15. The system of claim 14, wherein the second three-way valve is operable to direct the flow of the refrigerant from the third conduit to the fourth conduit in the interior space conditioning mode, and the second three-way valve is operable to direct the flow of the refrigerant from the fourth conduit to the inlet conduit in the water heating mode.

* * * * *